United States Patent [19]

Manerba

[11] 4,221,250

[45] Sep. 9, 1980

[54] METHOD FOR MAKING A GREAT CAPACITY BAG AND THE RELATED IMPROVED BAG

[76] Inventor: Giancarlo Manerba, Via Piave, 38, Leggiuno (Varese), Italy

[21] Appl. No.: 922,060

[22] Filed: Jul. 5, 1978

[30] Foreign Application Priority Data

Dec. 1, 1977 [IT] Italy ..... 30269 A/77

[51] Int. Cl.[3] ..... B65D 33/28; B65D 33/38

[52] U.S. Cl. ..... 150/3; 93/35 DS; 93/35 H; 93/35 PT; 93/35 SB; 150/1; 150/11; 150/12; 220/DIG. 25

[58] Field of Search ..... 150/0.5, 1, 11, 12, 150/3; 220/DIG. 25; 222/181; 93/95 SB, 35 PT, 35 DS, 35 H

[56] References Cited

U.S. PATENT DOCUMENTS

| | | | |
|---|---|---|---|
| 2,731,761 | 1/1956 | Marshall | 220/DIG. 25 |
| 3,374,929 | 3/1968 | Silfverskiöld | 222/181 X |
| 3,789,897 | 2/1974 | Saito | 150/1 X |
| 3,961,655 | 6/1976 | Nattrass et al. | 222/181 |
| 4,010,784 | 3/1977 | Nattrass et al. | 150/12 X |
| 4,143,796 | 3/1979 | Williamson | 222/181 X |

FOREIGN PATENT DOCUMENTS

| | | | |
|---|---|---|---|
| 281680 | 8/1913 | Fed. Rep. of Germany | 150/11 |
| 1092372 | 1/1959 | Fed. Rep. of Germany | 150/0.5 |
| 2328764 | 1/1975 | Fed. Rep. of Germany | 150/1 |
| 1009624 | 3/1952 | France | 150/11 |

*Primary Examiner*—Stephen P. Garbe

*Attorney, Agent, or Firm*—Bucknam and Archer

[57] ABSTRACT

A method for making an improved bag is described, in which the body of the bag, which has a square or rectangular base prism shape, is obtained by using two rectangular flaps preferably made of cloth, each flap being so folded, shaped and sized as to comprise a bag base wall and two opposing bag side walls, the flaps being associated or jointed by means of only one continuous seam or weld. The bag is provided with a loading mouth, a discharging mouth and suitable gripping members or handles. In a first step, the two flaps are folded so as to form the six walls in such a way that the first of said flaps has the middle portion thereof, constituting the top wall of the bag, upwardly directed, the side walls being downwardly directed, whereas the second flap is located in such a way that the middle wall thereof, constituting the bottom wall of the bag, is downwardly directed and the side walls thereof upwardly directed.

5 Claims, 5 Drawing Figures

Fig. 1
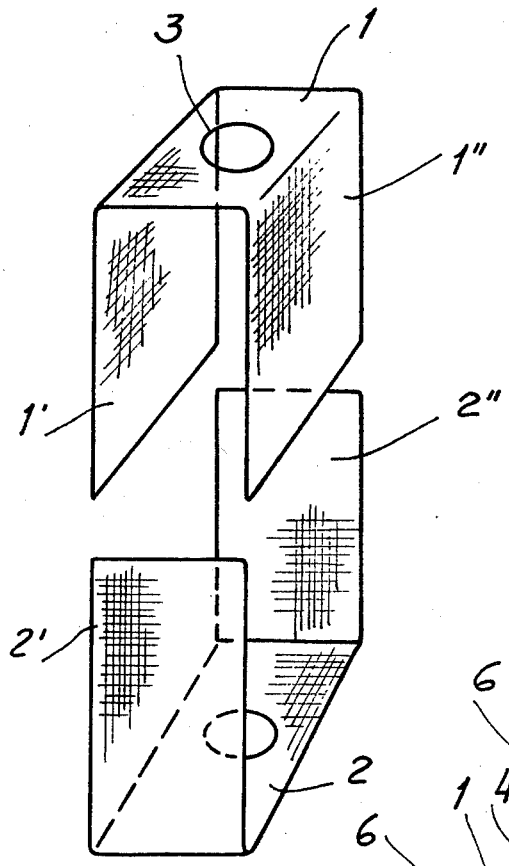
Fig. 2
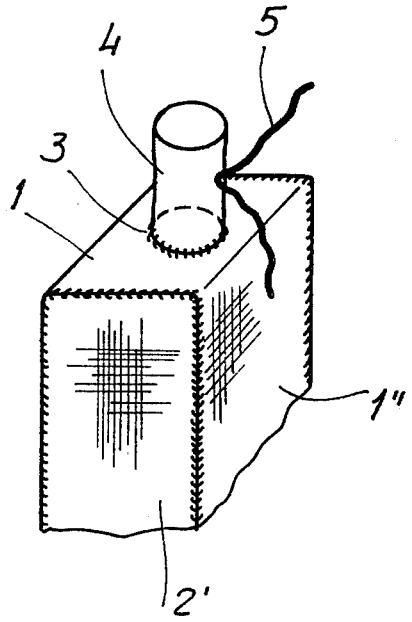
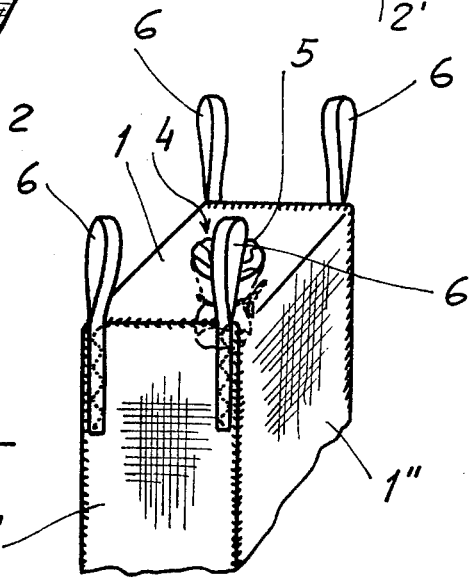
Fig. 3

METHOD FOR MAKING A GREAT CAPACITY BAG AND THE RELATED IMPROVED BAG

The present invention relates to a method particularly developed for making, in a quick and cheap way, a bag or container in general, of great capacity and strength, obtained by firmly associating, by means of one only seaming or welding continuous operation, two suitably shaped flaps of cloth or other convenient material.

The aforesaid type of bag or container meets several and different practical needs in that it is able to contain loose material, either of small size, or cut in pieces of remarkable size and weight.

Obviously, the utilized cloth should be able of meeting the single case needs and eventually it may be associated to or substituted for other suitable materials.

More precisely, the instant bag or container, comprises a square or rectangular-base prismatic body, being provided, at the upper zone thereof, with strong gripping members for raising and easily handling said bag.

Moreover, the method of manufacture of the present invention provides for the formation of a specially shaped upper loading mouth, provided with a closing cord, and of a lower discharging mouth, having an original and functional shape, which also permits to achieve a good closure.

These and other characteristics, of functional and constructional nature, of the instant making method and special type of bag, or container in general, of great capacity obtained thereby, will become more apparent from the figures of the accompanying drawings, where:

FIG. 1 is a perspective view of the two cloth flaps, yet in a disassembled or disassociated condition, for the formation of the bag body;

FIG. 2 illustrates the upper portion of the bag, at which the loading mouth is applied, said loading mouth being provided with a closing cord;

FIG. 3 illustrates the bag upper portion, with the loading mouth closed and with four strong gripping members fixed at the upper corners of the bag itself;

Figure 4:
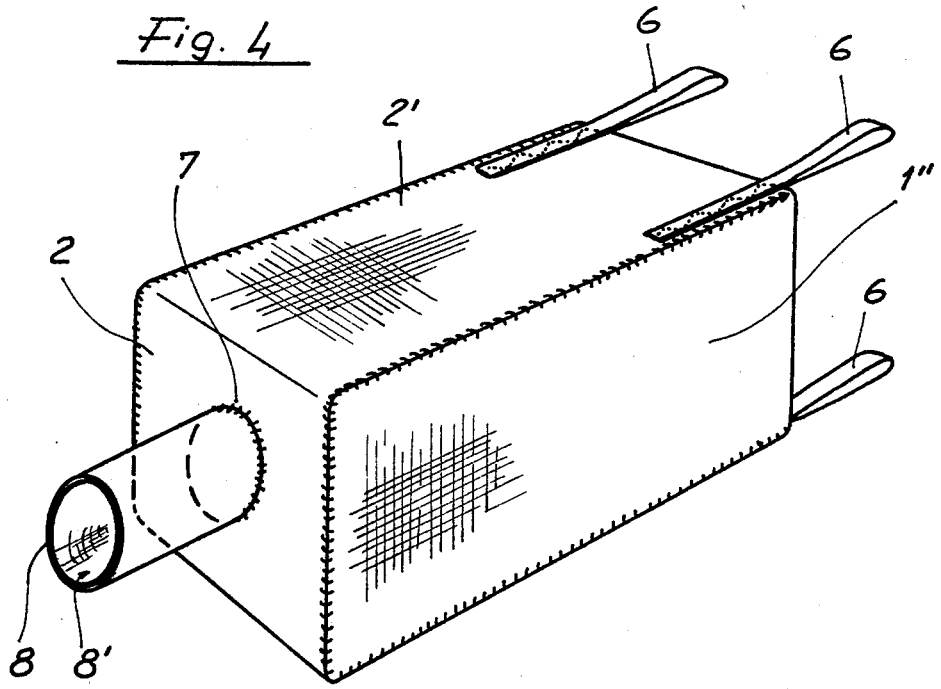
FIG. 4 illustrates the especially shaped discharging mouth, as applied at the bottom of the bag.

Referring specifically to the numerical references of the aforesaid figures, the instant bag comprises, essentially, two flaps, preferably of cloth, having a rectangular shape, each said flap being so sized as to include a bag base or bottom wall, shaped as a quadrangular prism and two opposite walls of said prism.

More precisely, one of the flaps will comprise the top wall (1) of the bag and the side walls (1') and (1'') thereof, and the other flap will comprise the bottom wall (2) of the bag and the side walls (2') and (2'') thereof.

It should be clear that flaps, suitably folded to form the six prism walls, and upon flanking to one another according to the manufacturing method of the invention, are able of constituting the bag body, by a preliminary seaming or welding operation for firmly associating or jointing the respective edges which have been brought in contact with one another.

Due to the particular arrangement of the thus obtained solid body, this seam will be continuous, in that it may be started at any point of the edges to be jointed and terminated at that same point, upon the formation of all eight corners, along which the two flaps are to be firmly connected (the other four corners are formed by the aforesaid folds of said flaps).

At a hole (3) formed in the top wall (1) of the bag, a cylindrical loading mouth (4) may be applied, also preferably by means of a seaming operation, said cylindrical mouth being formed by a seamed cloth piece or by a tubular cloth portion to which a suitable closing cord (5) is associated (see FIG. 2).

According to the method at the present invention, the bag is further provided with strong gripping members (6), so that said bag may be easily raised and transported, said gripping members (6) being perferably formed by belts applied at the upper zone or portion of the four vertical corners, by means of strong seams, for example of the "zig-zag" type (see FIG. 3).

In addition, at the bottom wall (2) thereof, the bag is provided with a hole (7) at which a particular type of discharging mouth may be applied, also preferably by means of a seaming operation.

Figure 5:
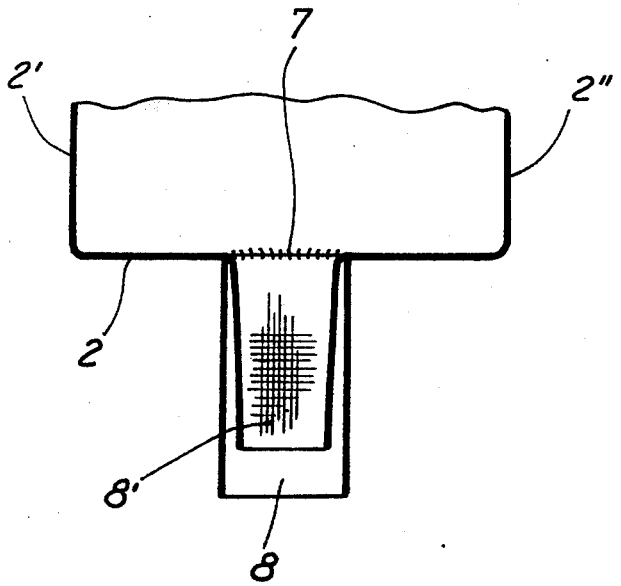
FIG. 5 illustrates the base portion of the bag, with the discharging mouth in a vertical cross section through a symmetry plane.

Actually said discharging mouth comprises two concentric cylindrical cloth members (8) and (8') which, in a particularly preferred embodiment, are formed by one only tubular element of suitable length, turned on itself and seamed to the edge of the hole (7) at the folding line thereof (see FIGS. 4 and 5).

The tubular element may be obtained by a seamed cloth piece or it may be a portion of tubular cloth.

The special shape of the discharging mouth allows a good closure of the bag, by inwardly folding, before filling the bag, the tubular member (8'), interposed between the two members forming the discharging mouth, which tubular member (8') is thus pressed by the material filled in the bag against the inner wall of the bottom.

In order to obtain a greater safety, it is possible, by using a cord or like means, to suitably bind the outer tubular member (8) under the bottom of the bag.

On the contrary, when the discharging mouth is to be used for removing the contents of the bag from the bottom thereof, the tubular outer member (8) is untied and then through said outer tubular member (8) the inner tubular member (8') is manually removed from the bottom of the bag contained compressed therein.

From the drawings and the above description the great simplicity of the method of manufacture and remarkable use functionality characterizing the great capacity bag or container in general obtained by the method of the present invention are self-evident.

I claim:

1. A method of manufacturing a bag which consists of folding a first rectangular member so as to form a first U-shaped panel having a central portion and two side portions essentially perpendicular thereto, folding a second rectangular member so as to form a second U-shaped panel having a central portion and two side portions essentially perpendicular thereto, placing said first U-shaped panel in an inverted position on top of said second U-shaped panel whereby the edges of the two side portions of the second panel are in contact with the edges of the central portion of the first panel, joining said first and second U-shaped panels along the edges thereof to form a bag of prismatic shape, said bag having a top wall formed from the central portion of said first U-shaped panel, a bottom wall formed from the central portion of said second V-shaped panel, and four side walls, making a circular orifice in said top wall, placing a cylindrical body over said orifice and seaming said cylindrical body along an edge thereof to the edge of said orifice to provide a loading mouth, making a second circular orifice in said bottom wall, placing a tubular element along the edge of said second circular orifice, folding said tubular element to form two concentric members and seaming said two concentric members to the edge of the second circular orifice along the folding line whereby a discharging mouth formed by two concentric members is obtained, and sewing a gripping member at each of the four corners of the top wall of the bag.

2. The method according to claim 1 wherein the inner member of said two concentric members is turned in the interior of the bag prior to filling the bag.

3. The method according to claim 2 wherein the outer member of said two concentric members is tied by means of a cord.

4. A bag having the shape of a prism formed from two rectangular members each of which has been folded in three panels, the central panels of the two members providing the top and the bottom wall of the prism respectively and the side panels of the two rectangular members providing the four side panels of the prism, said rectangular members having been so arranged that the two side walls of one member are in contact with the edges of the central portion of the other members, the two members being seamed by a continuous seam, said bag being provided with four gripping members at the four upper corner, a loading mouth in the upper wall and a discharging mouth in the bottom wall, cord means for tying said loading mouth and said discharging mouth and wherein said discharging mouth consists of two concentric cylindrical members seamed to the bottom wall along the edge of an orifice thereof.

5. The bag according to claim 4 wherein said two concentric cylindrical members are formed from one tubular element which has been folded and seamed to the edge of the orifice in said bottom wall along the folding line.

* * * * *